US008986045B2

(12) United States Patent
Okamoto et al.

(10) Patent No.: US 8,986,045 B2
(45) Date of Patent: Mar. 24, 2015

(54) CONNECTING STRUCTURE OF SHIELD BRAIDED PART

(71) Applicant: Yazaki Corporation, Tokyo (JP)

(72) Inventors: Kenichi Okamoto, Kakegawa (JP); Tomoharu Suzuki, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/056,305

(22) Filed: Oct. 17, 2013

(65) Prior Publication Data

US 2014/0045377 A1 Feb. 13, 2014

Related U.S. Application Data

(63) Continuation of application No. PCT/JP2012/064734, filed on Jun. 1, 2012.

(30) Foreign Application Priority Data

Jun. 2, 2011 (JP) ..... 2011-124436

(51) Int. Cl.

| | |
|---|---|
| ***H01R 13/648*** | (2006.01) |
| ***H01R 13/6593*** | (2011.01) |
| ***H01R 9/03*** | (2006.01) |
| *H01R 4/20* | (2006.01) |

(52) U.S. Cl.

CPC ..... *H01R 13/6593* (2013.01); *H01R 9/034* (2013.01); *H01R 4/203* (2013.01)

USPC ..... 439/607.41; 439/98

(58) Field of Classification Search

USPC ..... 439/607.41, 607.5, 607.52, 98, 99

See application file for complete search history.

(56) References Cited

U.S. PATENT DOCUMENTS

| | | | | |
|---|---|---|---|---|
| 3,566,006 | A | 2/1971 | Metcalf | |
| 3,654,584 | A * | 4/1972 | Gillemot et al. | 439/99 |
| 4,257,658 | A * | 3/1981 | Hammond et al. | 439/98 |
| 5,429,529 | A * | 7/1995 | Hashizawa et al. | 439/607.5 |
| 6,280,208 | B1 * | 8/2001 | Masuda et al. | 439/98 |
| 8,585,415 | B2 * | 11/2013 | Marsh et al. | 439/98 |
| 2002/0173181 | A1 * | 11/2002 | Matsumoto | 439/98 |

(Continued)

FOREIGN PATENT DOCUMENTS

JP 2010250995 A 11/2010

OTHER PUBLICATIONS

International Search Report, dated Sep. 11, 2012, issued by the International Searching Authority in counterpart International Application No. PCT/JP2012/064734.

(Continued)

*Primary Examiner* — Gary Paumen

(74) *Attorney, Agent, or Firm* — Sughrue Mion, PLLC

(57) ABSTRACT

A connecting structure of a shield braided part includes a shield shell that accommodates a connector housing which accommodates a terminal fitting connected to an end portion of an electric wire, and the shield shell including a tubular part which covers an outer periphery of the end portion of the electric wire, and a shield ring that is attached to an outer periphery of the tubular part of the shield shell and sandwiches an end portion of a tubular shield braided part covering the outer periphery of the electric wire between an outer peripheral face of the tubular part and the shield ring. A protruding part which protrudes toward the shield braided part is formed in the shield ring. A braided part insert hole is formed in the protruding part.

5 Claims, 7 Drawing Sheets

(56) References Cited

U.S. PATENT DOCUMENTS

| | | | | |
|---|---|---|---|---|
| 2004/0115975 | A1* | 6/2004 | Sato et al. | 439/98 |
| 2010/0261363 | A1 | 10/2010 | Sakakura | |
| 2010/0261365 | A1 | 10/2010 | Sakakura | |

OTHER PUBLICATIONS

Written Opinion, dated Sep. 11, 2012, issued by the International Searching Authority in counterpart International Application No. PCT/JP2012/064734.

* cited by examiner

CONNECTING STRUCTURE OF SHIELD BRAIDED PART

CROSS REFERENCE TO RELATED APPLICATIONS

This application is a continuation of PCT application No. PCT/JP2012/064734, which was filed on Jun. 1, 2012 based on Japanese Patent Application (No. P2011-124436) filed on Jun. 2, 2011, the contents of which are incorporated herein by reference.

BACKGROUND OF THE INVENTION

1. Field of the Invention

The present disclosure relates to a connecting structure of a shield braided part that electrically and mechanically connects a tubular part of a shield shell to the shield braided part of a shielded connector.

2. Description of the Related Art

FIG. 6 shows a usual example of a connecting structure of a shield braided part of a shielded connector that electrically and mechanically connects a tubular part of a shield shell to the shield braided part of the shielded connector.

The connecting structure of the shield braided part shown in FIG. 6 is disclosed in JP-A-2010-250995. A shielded connector 100 shown in FIG. 6 includes a connector housing 130 made of a resin which accommodates and holds a terminal fitting 120 connected to an end part of an electric wire 110, a shield shell 140 which accommodates the connector housing 130, a tubular shield braided part 150 which covers an outer periphery of the electric wire 110 and a shield ring 160 which connects an end part of the shield braided part 150 to the shield shell 140.

As shown in FIG. 6, the shield shell 140 has a tubular part 141 which covers the outer periphery of the end part of the electric wire 110 connected to the terminal fitting 120.

The outer periphery of the electric wire 110 is covered with the shield braided part 150 and an outer periphery of the tubular part 141 is covered with its end part.

The shield ring 160 is a tubular member made of metal that forms an annular gap 170 between the outer peripheral surface of the tubular part 141 and the shield ring 160, into which the end part of the shield braided part 150 can be inserted as shown in FIG. 7A, when the shield ring 160 is fitted and attached to the outer periphery of the tubular part 141.

In the connecting structure of the shield braided part shown in FIG. 6, under a state that the shield braided part 150 is inserted into the annular gap 170, a part of the shield ring 160 is pressed and deformed toward the tubular part 141 to form a pressed protruding part 161 deformed to protrude toward the shield braided part 150 as shown in FIG. 7B. Thus, when a state is formed that the shield braided part 150 is sandwiched between the pressed protruding part 161 and the tubular part 141, the shield braided part 150 is electrically and mechanically connected to the tubular part 141.

SUMMARY OF THE INVENTION

However, in the connecting structure of the shield braided part disclosed in JP-A-2010-250995, as shown in FIG. 7B, since a contact state of the shield braided part 150 and the pressed protruding part 161 is a surface contact state by smooth surfaces thereof, it is difficult to increase a binding strength of the pressed protruding part 161 and the shield braided part 150. Accordingly, a problem arises that an electrical and mechanical connecting strength between the tubular part 141 of the shield shell 140 of the shield shell 140 and the shield braided part 150 is hardly increased.

Further, in the connecting structure of the shield braided part disclosed in JP-A-2010-250995, when a dimension of the pressed protruding part 161 is increased to increase a pressed area by the pressed protruding part 161, the binding strength between the pressed protruding part and the shield braided part is enhanced so that the electrical and mechanical connecting strength between the tubular part 141 and the shield braided part 150 may be improved.

However, when the dimension of the pressed protruding part 161 is increased, there is a fear that the width of the shield ring 160 is increased to make the shield ring 160 large or heavy.

Thus, a purpose of the present disclosure resides in solving the above-described problems and it is an object of the present disclosure to provide a connecting structure of a shield braided part which can improve an electrical and mechanical connecting strength of a tubular part of a shield shell and a shield braided part and reduce a width of a shield ring so as to make the shield ring compact and light.

The above-described object of the present disclosure is achieved by below-described structures.

(1) A connecting structure of a shield braided part, comprising:

a shield shell that accommodates a connector housing which accommodates a terminal fitting connected to an end portion of an electric wire, and the shield shell including a tubular part which covers an outer periphery of the end portion of the electric wire; and a shield ring that is attached to an outer periphery of the tubular part of the shield shell and sandwiches an end portion of a tubular shield braided part covering the outer periphery of the electric wire between an outer peripheral face of the tubular part and the shield ring, wherein a protruding part which protrudes toward the shield braided part is formed in the shield ring; and wherein a braided part insert hole is formed in the protruding part.

(2) The connecting structure of the shield braided part according to the above-described (1), wherein a part of the shield braided part is inserted into the braided part insert hole in a state that the shield braided part is sandwiched between the shield ring and the tubular part.

(3) The connecting structure of the shield braided part according to the above-described (1) or (2), wherein the braided part insert hole is formed in an apex of the protruding part.

(4) The connecting structure of the shield braided part according to the above-described (1) or (2), wherein the braided part insert hole and other braided part insert holes are formed in the shield ring at predetermined intervals in a circumferential direction of the shield ring.

(5) The connecting structure of the shield braided part according to the above-described (1) or (2), wherein the protruding part is formed by caulking the shield ring to the braided part.

In the connecting structure of the shield braided part according to the present disclosure, since the shield braided part is engaged with the protruding part by fitting the protruding part to the recessed part due to the braided part insert holes opened in the protruding part formed in the shield ring, the binding strength between the protruding part and the shield braided part can be improved. Further, since the braided part insert holes are formed, the area of the part in which the protruding part is formed is the more reduced. Thus, the protruding part is easily pressed and deformed, so that the pressure contact force of the protruding part to the tubular part of the shield shell can be improved.

Since the improvement of the binding strength between the protruding part and the shield braided part and the improvement of the pressure contact force of the protruding part to the tubular part of the shield shell are involved, the electrical and mechanical connecting strength of the tubular part of the shield shell and the shield braided part can be improved.

Further, since the shield braided part is engaged with the protruding part by fitting the protruding part to the recessed part to improve the binding strength between the protruding part and the shield braided part, even when the dimension of the protruding part is reduced, the binding strength between the protruding part and the shield braided part can be prevented from lowering. Accordingly, the dimension of the protruding part is reduced to reduce the width of the shield ring so that the shield ring may be made to be compact and light.

DETAILED DESCRIPTION OF THE EXEMPLARY EMBODIMENTS

Now, a preferred exemplary embodiment of a connecting structure of a shield braided part according to the present disclosure will be described below in detail by referring to FIG. 1 to FIG. 5.

Figure 1:
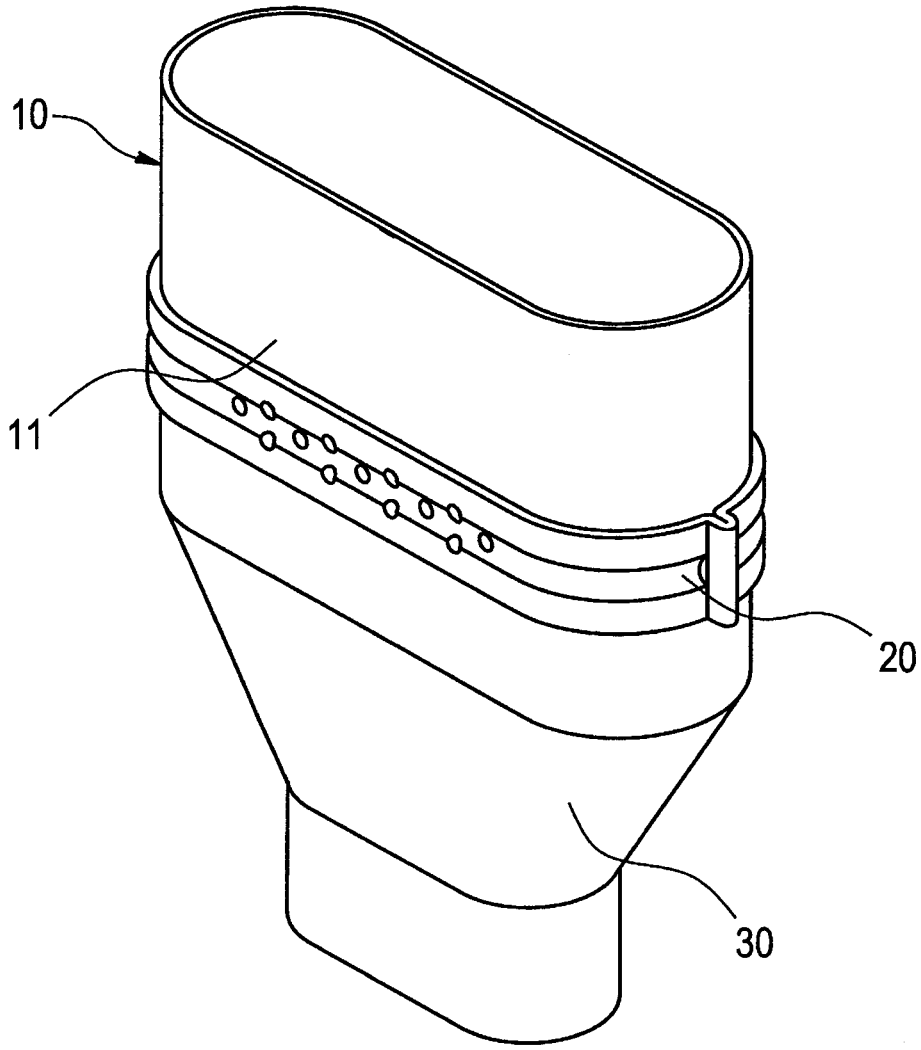
FIG. 1 is a perspective view showing an assembled state of a shield shell, a shield braided part and a shield ring which form one exemplary embodiment of a connecting structure of a shield braided part according to the present disclosure.
Figure 2:
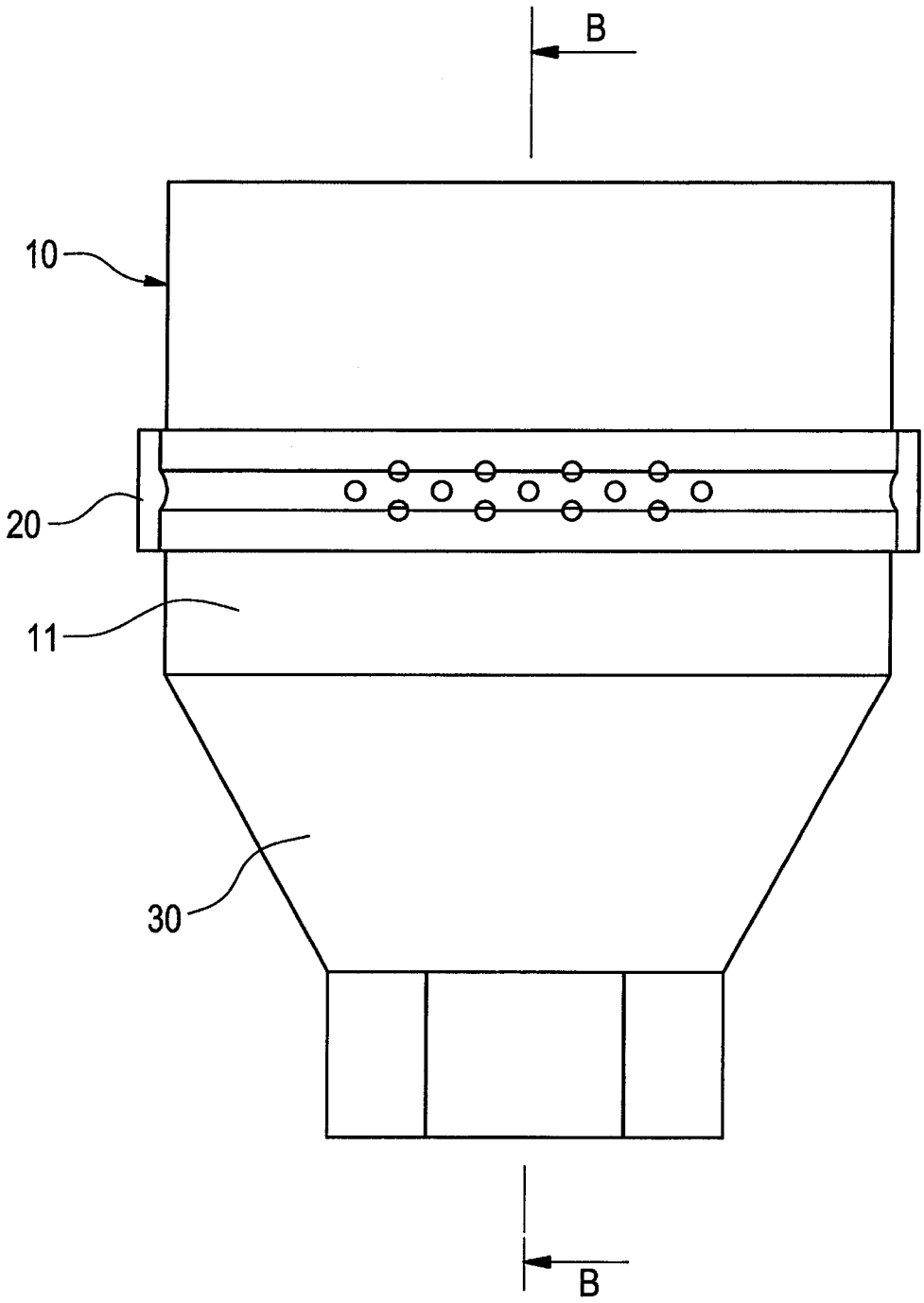
FIG. 2 is a plan view of an assembly shown in FIG. 1.
Figure 3:
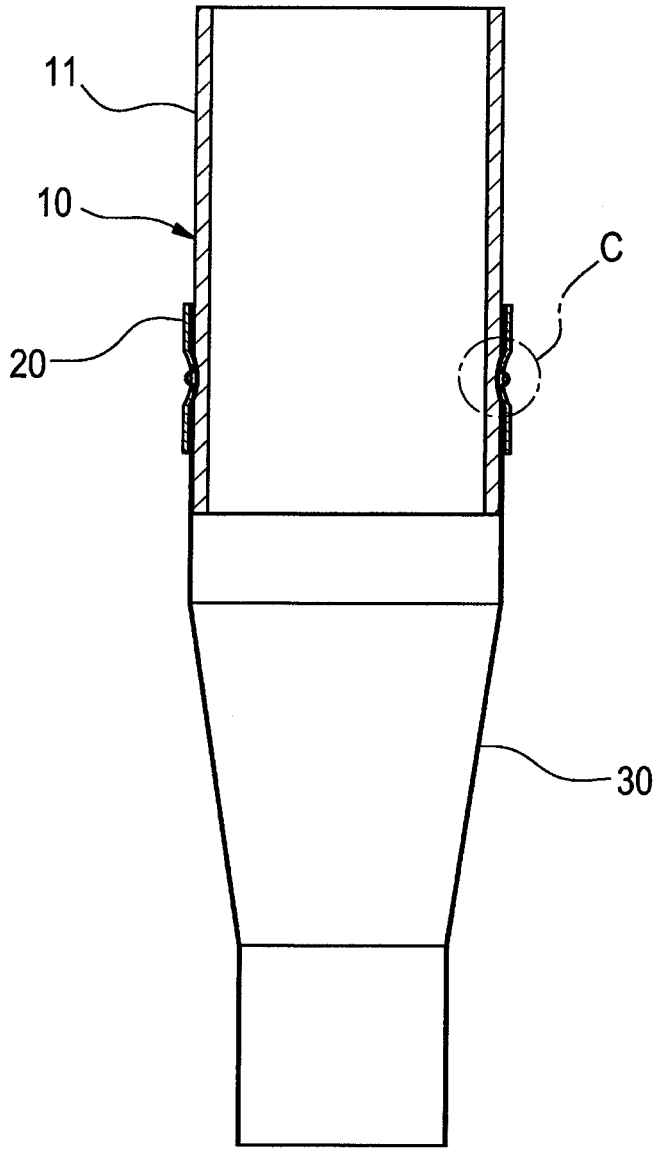
FIG. 3 is a sectional view taken along a line B-B in FIG. 2.
Figure 4:
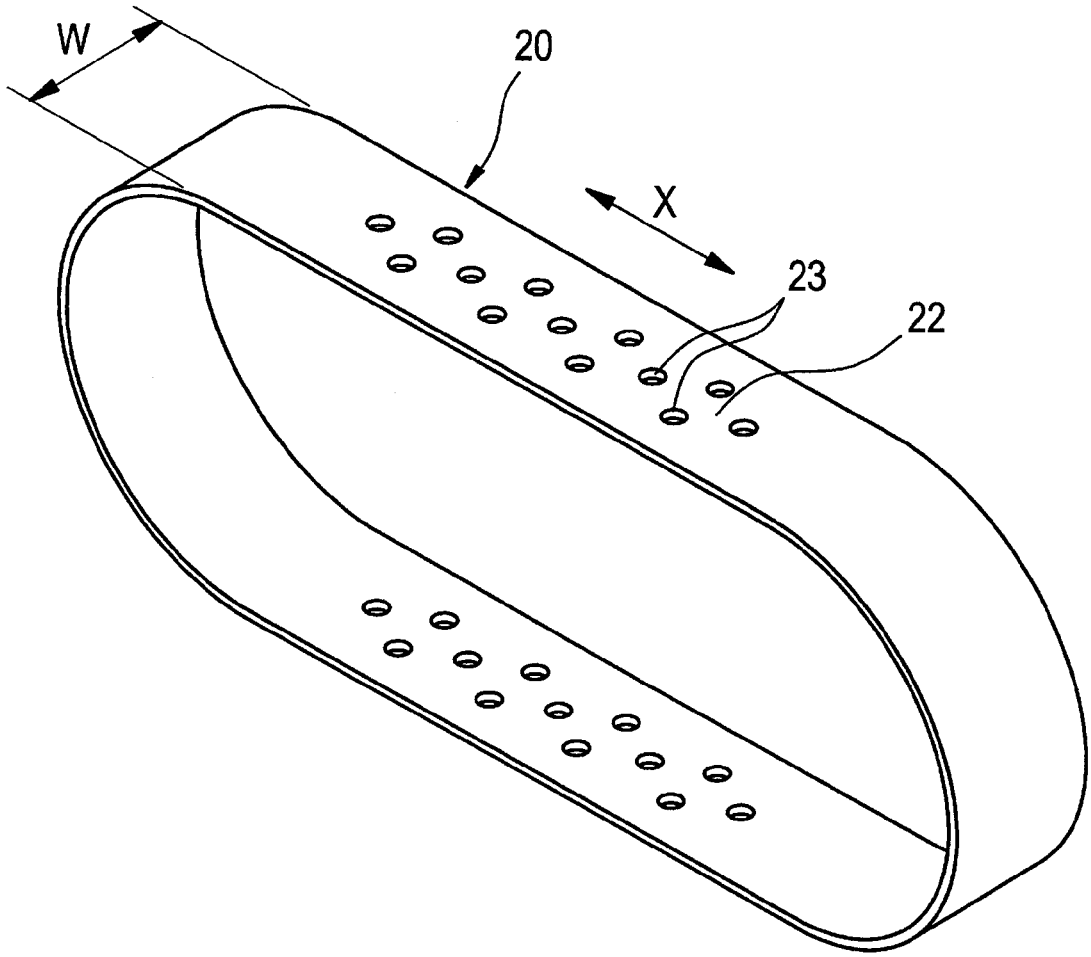
FIG. 4 is a perspective view of the shield ring shown in FIG. 1.
Figure 5:
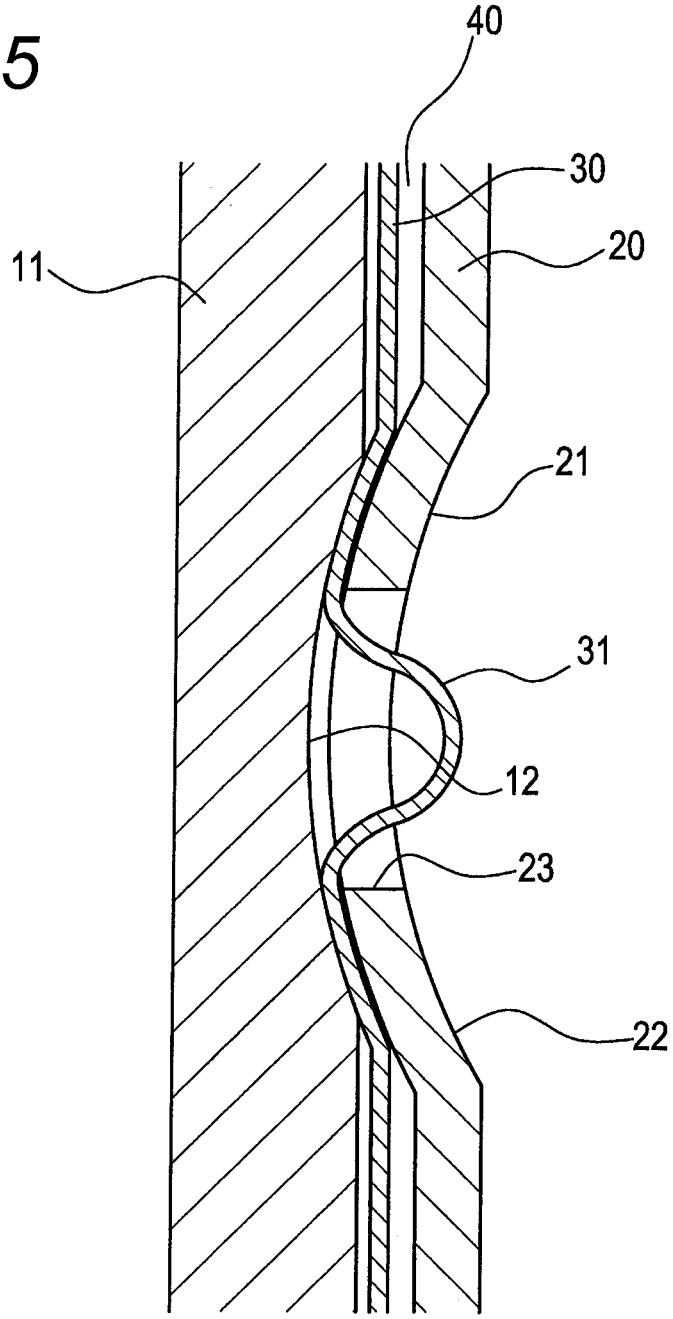
FIG. 5 is an enlarged view of a part C shown in FIG. 3.
Figure 6:
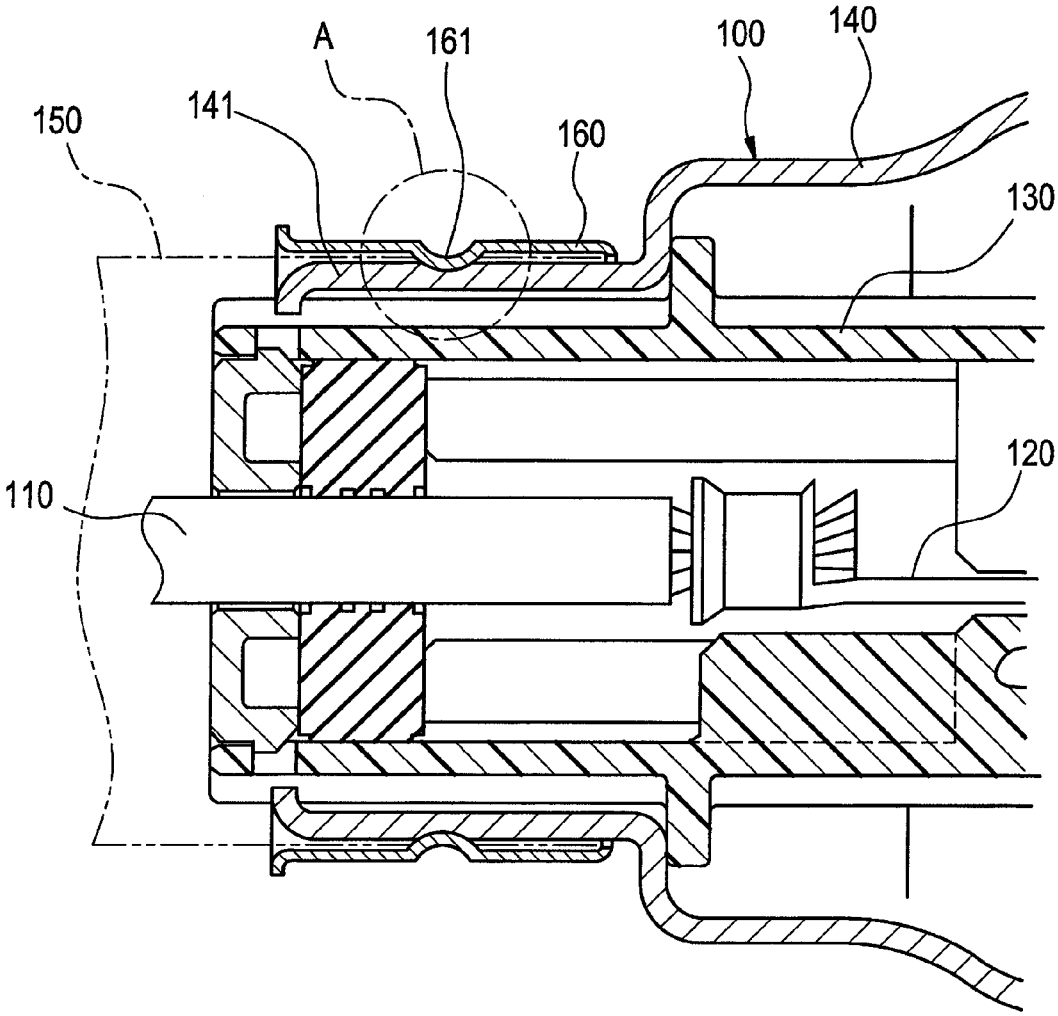
FIG. 6 is a longitudinally sectional view of main parts of a shielded connector showing a usual connecting structure of a shield braided part.
Figure 7A:
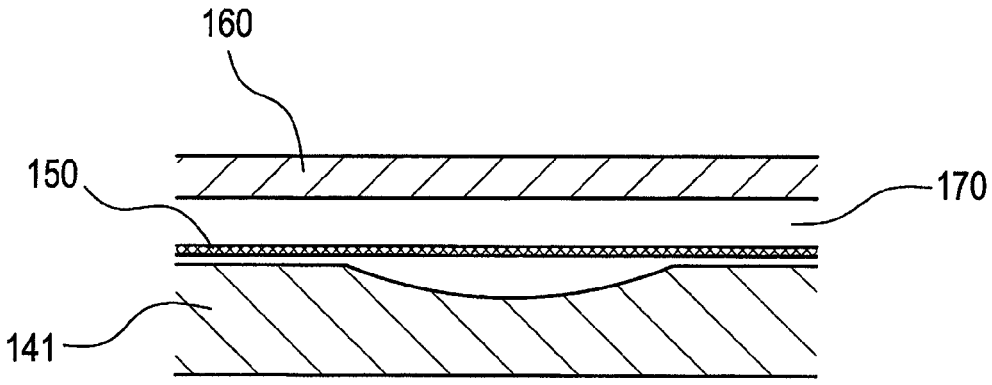
FIG. 7A is an enlarged view showing a state before a pressed protruding part is formed by pressure in a part A in FIG. 6.
Figure 7B:
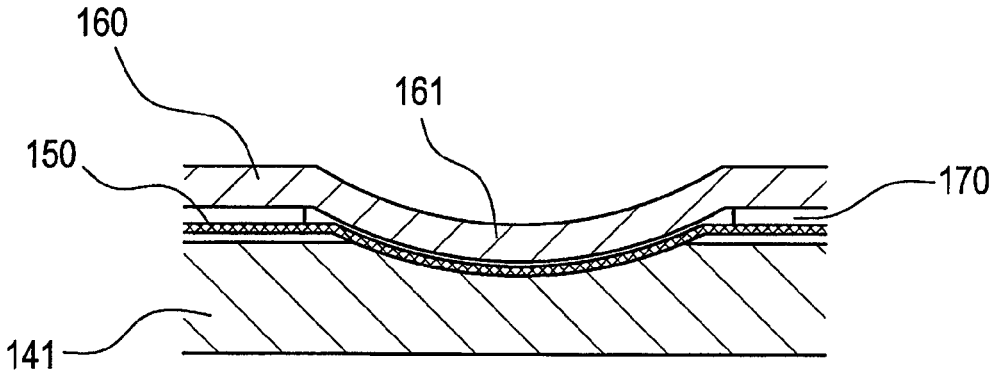
FIG. 7B is an enlarged view of the part A in FIG. 6.

FIG. 1 is a perspective view showing an assembled state of a shield shell, a shield braided part and a shield ring which form one exemplary embodiment of the connecting structure of the shield braided part according to the present disclosure. FIG. 2 is a plan view of an assembly shown in FIG. 1. FIG. 3 is a sectional view taken along a line B-B in FIG. 2. FIG. 4 is a perspective view of the shield ring shown in FIG. 1. FIG. 5 is an enlarged view of a part C shown in FIG. 3.

The connecting structure of the shield braided part of the one exemplary embodiment is used in a shielded connector, and includes, as shown in FIG. 1 to FIG. 3, a shield shell 10 and a shield ring 20.

The shield shell 10 accommodates a connector housing made of a resin that accommodates and holds a terminal fitting connected to an end portion of an electric wire. The shield shell 10 has a tubular part 11 which covers an outer periphery of the end portion of the electric wire connected to the connector housing made of the resin. In the case of the present exemplary embodiment, the tubular part 11 has an elliptic form in cross-section. To the tubular part 11, an end part of a tubular shield braided part 30 which covers the outer periphery of the electric wire connected to the connector housing is fitted and attached.

As shown in 4, the shield ring 20 has an elliptic tubular form in cross-section. An inside diameter of the shield ring 20 is set to be larger than that of the tubular part 11. The shield ring 20 is fitted to an outer periphery of the tubular part 11 to form an annular gap 40 between the outer peripheral surface of the tubular part 11 and the shield ring 20.

The annular gap 40 is a gap into which the end part of the tubular shield braided part 30 which covers the outer periphery of the electric wire can be inserted.

In the connecting structure of the shield braided part of the present exemplary embodiment, as shown in FIG. 5, in a state that the shield braided part 30 is inserted into the annular gap 40, a part of the shield ring 20 is pressed and deformed toward the tubular part 11 to form a protruding part 21, which will be referred to as a pressed protruding part 21, hereinafter. The pressed protruding part 21 has a protruding form bent toward the shield braided part 30. In order to easily and assuredly form the pressed protruding part 21, on the tubular part 11 opposed to the pressed protruding part 21, a recessed part 12 corresponding to the form of the pressure protruding part 21 is previously formed as shown in FIG. 5.

In the connecting structure of the shield braided part of the present exemplary embodiment, as shown in FIG. 5, a state is formed that the shield braided part 30 is sandwiched between the pressed protruding part 21 and the tubular part 11 so that the shield braided part 30 is electrically and mechanically connected to the tubular part 11.

In the case of the connecting structure of the shield braided part of the present exemplary embodiment, as shown in FIG. 4, a plurality of braided part insert holes 23 are previously formed in a part 22 in which the pressed protruding part 21 of the shield ring 20 is formed.

The part 22 in which the pressed protruding part 21 is formed is an area located in a central part of a width W of the shield ring 20.

The braided part insert hole 23 is an opening into which a part 31 of the shield braided part 30 is inserted as shown in FIG. 5 when the part 22 in which the pressed protruding part 21 is formed is pressed and deformed toward the shield braided part 30.

In the shield ring 20 of the present exemplary embodiment, the plurality of braided part insert holes 23 are provided at suitable intervals in the circumferential direction (a direction shown by an arrow mark X in FIG. 4) as shown in FIG. 4.

In the connecting structure of the shield braided part of the above-described exemplary embodiment, when a part of the shield ring 20 is pressed and deformed toward the tubular part 11 to form the pressed protruding part 21 under the state the shield braided part 30 is inserted into the annular gap 40 between the tubular part 11 of the shield shell 10 and the shield ring 20, as shown in FIG. 5, a part 31 of the shield braided part 30 pressed by the pressed protruding part 21 penetrates into the braided part insert hole 23 opened in the pressed protruding part 21. Thus, the shield braided part 30 is engaged with the pressed protruding part 21 by fitting a protruding part to a recessed part. Accordingly, a binding strength between the pressed protruding part 21 and the shield braided part 30 can be improved.

Further, since the braided part insert holes 23 are formed, the area of the part 22 in which the pressed protruding part 21 is formed is the more reduced. Thus, the part 22 in which the pressed protruding part 21 is formed is easily pressed and deformed, so that a pressure contact force of the pressed protruding part 21 to the tubular part 11 of the shield shell 10 can be improved.

Since the improvement of the binding strength between the pressed protruding part 21 and the shield braided part 30 and the improvement of the pressure contact force of the pressed protruding part 21 to the tubular part 11 of the shield shell 10 are involved, an electrical and mechanical connecting strength of the tubular part 11 of the shield shell 10 and the shield braided part can be improved.

Further, since the shield braided part 30 is engaged with the pressed protruding part 21 by fitting the protruding part to the recessed part to improve the binding strength between the pressed protruding part 21 and the shield braided part 30, even when a dimension of the pressed protruding part 21 is reduced, the binding strength between the pressed protruding part 21 and the shield braided part 30 can be prevented from lowering. Accordingly, the dimension of the pressed protruding part 21 is reduced to reduce the width W of the shield ring 20 so that the shield ring 20 may be made to be compact and light.

Further, in the connecting structure of the shield braided part of the above-described exemplary embodiment, a plurality of fitting engagements of the protruding parts and the recessed parts between the shield braided part 30 and the shield ring 20 are formed at suitable intervals in the circumferential direction of the shield ring 20 by the plurality of braided part insert holes 23 provided in the shield ring 20.

As a result, between the shield braided part 30 and the shield ring 20, a more stable binding strength can be ensured and a reliability can be improved in the electrical and mechanical connection of the tubular part 11 of the shield shell 10 and the shield braided part 30.

The connecting structure of the shield braided part 30 of the present disclosure is not limited to the above-described exemplary embodiment and may be suitably modified and improved.

For instance, the number of the provided braided part insert holes 23 or the sizes of the braided part insert holes 23 may be suitably changed in their design. Further, the cross-sectional form of the tubular part 11 or the shield ring 20 is not limited to the elliptic form and a true circular form may be used.

Further, the shield ring may be formed by a plurality of divided bodies which form the shape of the ring. In this case, the plurality of divided bodies may be integrally connected by, for instance, bolts and nuts and fixed to the shield shell. Further, the divided bodies may be connected together by caulking their end parts integrally and fixed to the shield shell.

Further, the shield ring may be formed in such a way that a part of a circumferential part in the shield ring is opened and flange parts provided at both the opened end parts of the shield ring are fastened by, for instance, bolts and nuts to reduce a diameter.

Further, the protruding part 21 may be previously formed so as to protrude or to be recessed and protrude in the shield ring 20.

Here, the details of the above embodiments are summarized as follows.

A connecting structure of a shield braided part, comprising:

a shield shell that accommodates a connector housing which accommodates a terminal fitting connected to an end portion of an electric wire, and the shield shell including a tubular part which covers an outer periphery of the end portion of the electric wire; and a shield ring that is attached to an outer periphery of the tubular part of the shield shell and sandwiches an end portion of a tubular shield braided part covering the outer periphery of the electric wire between an outer peripheral face of the tubular part and the shield ring, wherein a protruding part which protrudes toward the shield braided part is formed in the shield ring; and wherein a braided part insert hole is formed in the protruding part.

For example, a part of the shield braided part is inserted into the braided part insert hole in a state that the shield braided part is sandwiched between the shield ring and the tubular part.

For example, the braided part insert hole is formed in an apex of the protruding part.

For example, the braided part insert hole and other braided part insert holes are formed in the shield ring at predetermined intervals in a circumferential direction of the shield ring.

For example, the protruding part and other protruding parts are formed in the shield ring at predetermined intervals in a circumferential direction of the shield ring, and the braided part insert hole and other braided part insert holes are formed in the protruding part and the other protruding parts correspondingly.

For example, the protruding part is formed by caulking the shield ring to the braided part.

According to the above structures, under a state that the shield braided part is sandwiched between the tubular part of the shield shell and the shield ring, a part of the shield braided part pressed by the protruding part penetrates into the braided part insert hole opened in the protruding part. Thus, the shield braided part is engaged with the protruding part by fitting a protruding part to a recessed part. Accordingly, a binding strength between the protruding part and the shield braided part can be improved. Further, since the braided part insert holes are formed, an area of a part in which the protruding part is formed is the more reduced. Thus, the part in which the protruding part is formed is easily pressed and deformed, so that a pressure contact force of the protruding part to the tubular part of the shield shell can be improved.

Since the improvement of the binding strength between the protruding part and the shield braided part and the improvement of the pressure contact force of the protruding part to the tubular part of the shield shell are involved, an electrical and mechanical connecting strength of the tubular part of the shield shell and the shield braided part can be improved.

Further, since the shield braided part is engaged with the protruding part by fitting the protruding part to the recessed part to improve the binding strength between the protruding part and the shield braided part, even when a dimension of the protruding part is reduced, the binding strength between the protruding part and the shield braided part can be prevented from lowering. Accordingly, the dimension of the protruding part is reduced to reduce the width of the shield ring so that the shield ring may be made to be compact and light.

The shield ring may have a ring structure formed with one parts or formed by connecting together a plurality of divided bodies under a caulking operation by the use of bolts and nuts.

Further, the protruding part may be previously formed so as to protrude or to be recessed and protrude in the shield ring. Further, the protruding part may be formed to protrude by caulking the shield ring.

According to the structures, a plurality of fitting engagements of the protruding parts and the recessed parts between the shield braided part and the shield ring are formed at suitable intervals in the circumferential direction of the shield ring by the plurality of braided part insert holes provided in the shield ring. As a result, between the shield braided part and the shield ring, a more stable binding strength can be ensured and a reliability can be improved in the electrical and mechanical connection of the tubular part of the shield shell and the shield braided part.

According to the structures, since the protruding part is formed by caulking the shield ring to the braided part, the protruding part is easily worked.

By the present disclosure, a connecting structure of a shield braided part which can improve an electrical and mechanical connecting strength of a tubular part of a shield shell and a shield braided part and reduce a width of a shield ring so as to make the shield ring compact and light can be obtained.

What is claimed is:

1. A connecting structure of a shield braided part, comprising:

a shield shell that accommodates a connector housing which accommodates a terminal fitting connected to an end portion of an electric wire, and the shield shell including a tubular part which covers an outer periphery of the end portion of the electric wire; and a shield ring that is attached to an outer periphery of the tubular part of the shield shell and sandwiches an end portion of a tubular shield braided part covering the outer periphery of the electric wire between an outer peripheral face of the tubular part and the shield ring, wherein a protruding part which protrudes toward the shield braided part is formed in the shield ring; and wherein a braided part insert hole is formed in the protruding part.

2. The connecting structure of the shield braided part according to claim 1, wherein a part of the shield braided part is inserted into the braided part insert hole in a state that the shield braided part is sandwiched between the shield ring and the tubular part.

3. The connecting structure of the shield braided part according to claim 1, wherein the braided part insert hole is formed in an apex of the protruding part.

4. The connecting structure of the shield braided part according to claim 1, wherein the braided part insert hole and other braided part insert holes are formed in the shield ring at predetermined intervals in a circumferential direction of the shield ring.

5. The connecting structure of the shield braided part according to claim 1, wherein the protruding part is formed by caulking the shield ring to the braided part.

* * * * *